US009915039B2

(12) United States Patent
Rudge

(10) Patent No.: US 9,915,039 B2
(45) Date of Patent: Mar. 13, 2018

(54) DEVICE FOR CLEANING THE DRUM SURFACE OF ASPHALT COMPACTORS

(71) Applicants: VOLVO CONSTRUCTION EQUIPMENT AB, Eskilstuna (SE); Brian Rudge, Carlisle, PA (US)

(72) Inventor: Brian Rudge, Carlisle, PA (US)

(73) Assignee: Volvo Construction Equipment AB (SE)

( * ) Notice: Subject to any disclaimer, the term of this patent is extended or adjusted under 35 U.S.C. 154(b) by 80 days.

(21) Appl. No.: 14/916,390

(22) PCT Filed: Sep. 5, 2013

(86) PCT No.: PCT/US2013/058231
§ 371 (c)(1),
(2) Date: Mar. 3, 2016

(87) PCT Pub. No.: WO2015/034502
PCT Pub. Date: Mar. 12, 2015

(65) Prior Publication Data

US 2016/0194839 A1 Jul. 7, 2016

(51) Int. Cl.
*E01C 19/00* (2006.01)
*E01C 19/23* (2006.01)

(52) U.S. Cl.
CPC ..... *E01C 19/238* (2013.01)

(58) Field of Classification Search
CPC ..... E01C 19/238
(Continued)

(56) References Cited

U.S. PATENT DOCUMENTS 562,167 A * 6/1896 Booth et al. ..... E01C 19/238 404/129
1,722,907 A * 7/1929 Liddle ..... E01C 19/238 310/57

(Continued)

FOREIGN PATENT DOCUMENTS

CN 102380477 A 3/2012
CN 102392408 A 3/2012

(Continued)

OTHER PUBLICATIONS

First Office Action (in Chinese) issued by the State Intellectual Property Office (SIPO) dated Sep. 13, 2016 regarding corresponding Patent Application No. CN 201380079418.X (7 pages).

(Continued)

*Primary Examiner* — Raymond W Addie
(74) *Attorney, Agent, or Firm* — Harness, Dickey & Pierce, PLC

(57) ABSTRACT

A device for cleaning a drum surface of an asphalt compactor. The device has a first and a second brackets fixed to a body of the compactor, a first supporting arm pivotably connected to the first bracket, a second supporting arm pivotably connected to the second bracket, a roller shaft supported by the supporting arms and is parallel to the rotation axis of the drum, a roller wiper mounted to the roller shaft and is extending along the width of the drum, contacting the surface of the drum. The device further has elastic members engaged between the brackets and the supporting arms. These elastic members are pressing the roller wiper against the surface of the drum. The roller wiper of the device has an enhanced lifespan.

18 Claims, 4 Drawing Sheets

(58) Field of Classification Search
USPC ..... 404/129
See application file for complete search history.

(56) References Cited

U.S. PATENT DOCUMENTS

| | | | | | |
|---|---|---|---|---|---|
| 2,582,199 | A * | 1/1952 | Gardner | E01C 19/236 | 172/547 |
| 2,830,511 | A * | 4/1958 | Wills | E01C 19/238 | 404/128 |
| RE26,675 | E * | 9/1969 | Elliot | E01C 19/238 | 404/129 |
| 3,802,339 | A * | 4/1974 | Andersson | E01C 19/28 | 100/174 |
| 3,875,666 | A | 4/1975 | Cline | | |
| 4,040,762 | A | 8/1977 | Nilsson | | |
| 4,348,134 | A | 9/1982 | Goehler | | |
| 4,378,052 | A | 3/1983 | Anderson | | |
| 5,222,828 | A | 6/1993 | Magalski | | |
| 5,988,940 | A | 11/1999 | Johansson | | |
| 9,624,633 | B1 * | 4/2017 | Judin | E01H 5/061 | |

FOREIGN PATENT DOCUMENTS

| | | | |
|---|---|---|---|
| CN | 102985615 | A | 3/2013 |
| WO | WO-9309296 | A1 | 5/1993 |
| WO | WO-2015034497 | A1 | 3/2015 |
| WO | WO-2015034501 | A1 | 3/2015 |
| WO | WO-2015122926 | A1 | 8/2015 |

OTHER PUBLICATIONS

International Search Report and Written Opinion of the International Searching Authority for PCT/US2013/058231, dated Jun. 16, 2014; ISA/KR.

* cited by examiner

DEVICE FOR CLEANING THE DRUM SURFACE OF ASPHALT COMPACTORS

CROSS-REFERENCE TO RELATED APPLICATION

This application is a 371 U.S. National Stage of International Application No. PCT/US2013/058231 filed on Sep. 5, 2013, the entire disclosure of which is incorporated herein by reference.

FIELD OF THE INVENTION

The present invention relates to asphalt compactors, and more particularly, to a device for cleaning the surface of the drums of asphalt compactors.

BACKGROUND OF THE INVENTION

Asphalt compactors are mobile vehicles used to compact asphalt in the construction of roads and foundations. Such compactors are generally equipped with two steel drums, one at each end of the machine. It is required that the exterior surface of drums used on such asphalt compactors should be property watered and cleaned to prevent adherence of particles or other material during their use.

Water sprays and wipers are typically used for this purpose. Water sprays are to wet the drum surface, providing a coolant and lubricant to give protection, while wipers are to apply cleaning of the drum surface and to evenly distribute water across the drum surface. A partial coverage of water across the drum surface, occurring from a plugged or damaged water spray nozzle or through evaporation, causes a section of the drum surface to become dried. In that case, it is more likely that particles could adhere to the surface. This would jeopardize the finish requirements for the job and require rework of that section of the jobsite.

FIG. 1 shows a typical prior art drum surface lubricating and cleaning device used on asphalt compactors having a water spray 101 and a spring-loaded wiper 102 which is in contact with the surface of drum 103. A plurality of brackets 104*a*, 104*b* are fixed to a body 105 of the vehicle, and support arms 106*a*, 106*b* are pivotably mounted on brackets 104*a*, 104*b*. Support arms 106*a*, 106*b* extend downward toward drum 103. A mounting plate 107 is fixed to support arms 106*a*, 106*b*. Mounting plate 107 is spaced above drum 103 and extends along the width of drum 103. Wiper blade 102 is attached to mounting plate 107. Wiper blade 102 extends along the width of drum 103 and contacts the surface of drum 103. Torsion springs 108*a*, 108*b* engaged between brackets 104*a*, 104*b* and support arms 106*a*, 106*b* elastically press wiper blade 102 against the surface of drum 103.

Such wipers are made of flexible material, such as, polyurethane, styrene butadiene, etc. However, due to continuous sliding friction, wipers are worn out easily and have short lifespan. Consequently, regular and frequent replacement of wipers is required.

SUMMARY OF THE INVENTION

Technical Problems

The present invention has been developed with attention paid to these problems encountered in the above-described related techniques. Therefore, the objects of the present invention include providing a device for cleaning the drum surface of asphalt compactors wherein the wiper has a substantially enhanced lifespan, and wherein the device can maintain a constant performance throughout the entire lifetime of the wiper in use.

Technical Solution

In order to achieve the aforementioned objects, the present invention employs the following arrangement.

According to one aspect of the present invention, there is provided a device for cleaning a drum surface of an asphalt compactor, comprising:

a first and a second brackets fixed to a body of said compactor, said brackets being spaced from each other and extending downward;

a first supporting arm pivotably connected to said first bracket, said first supporting arm extending downward toward said drum;

a second supporting arm pivotably connected to said second bracket, said second supporting arm extending downward toward said drum;

a roller shaft supported by said supporting arms, said roller shaft being parallel to the rotation axis of said drum and extending along the width of said drum;

a roller wiper mounted to said roller shaft, said roller wiper extending along the width of said drum and contacting the surface of said drum;

a first elastic member engaged between said first bracket and said first supporting arm and elastically pressing said roller wiper against the surface of said drum; and a second elastic member engaged between said second bracket and said second supporting arm and elastically pressing said roller wiper against the surface of said drum.

It is preferable that said first elastic member is a torsion spring with a first end fixed to said first bracket and a second end positioned in a notch formed on said first supporting arm, and said second elastic member is a torsion spring with a first end fixed to said second bracket and a second end positioned in a notch formed on said second supporting arm.

It is more preferable that said first elastic member is a torsion spring with a first end fixed to said first bracket and a second end positioned in one of a plurality of notches formed on said first supporting arm along the length thereof, and said second elastic member is a torsion spring with a first end fixed to said second bracket and a second end positioned in one of a plurality of notches formed on said second supporting arm along the length thereof.

Advantageous Effect

According to the present invention, the roller wiper is worn at a much lower rate from rolling friction, which substantially increases its lifespan. Even when the roller wiper is worn, the abrasion takes place uniformly across the entire surface of the roller wiper. Furthermore, by adjusting the tension of the elastic member corresponding to the reduced diameter of the roller wiper due to abrasion, a proper and constant contact force of the roller wiper against the drum surface can be maintained during the entire lifetime of the roller wiper.

DETAILED DESCRIPTION OF THE INVENTION

Reference will now be made in detail to embodiments of the present invention, examples of which are illustrated in the accompanying drawings. While the present invention will be described in conjunction with the following embodiments, it will be understood that they are not intended to limit the present invention to these embodiments alone. On the contrary, the present invention is intended to cover alternatives, modifications, and equivalents which may be included within the spirit and scope of the present invention as defined by the appended claims. Furthermore, in the following detailed description of the present invention, numerous specific details are set forth in order to provide a thorough understanding of the present invention. However, embodiments of the present invention may be practiced without these specific details.

Figure 1:
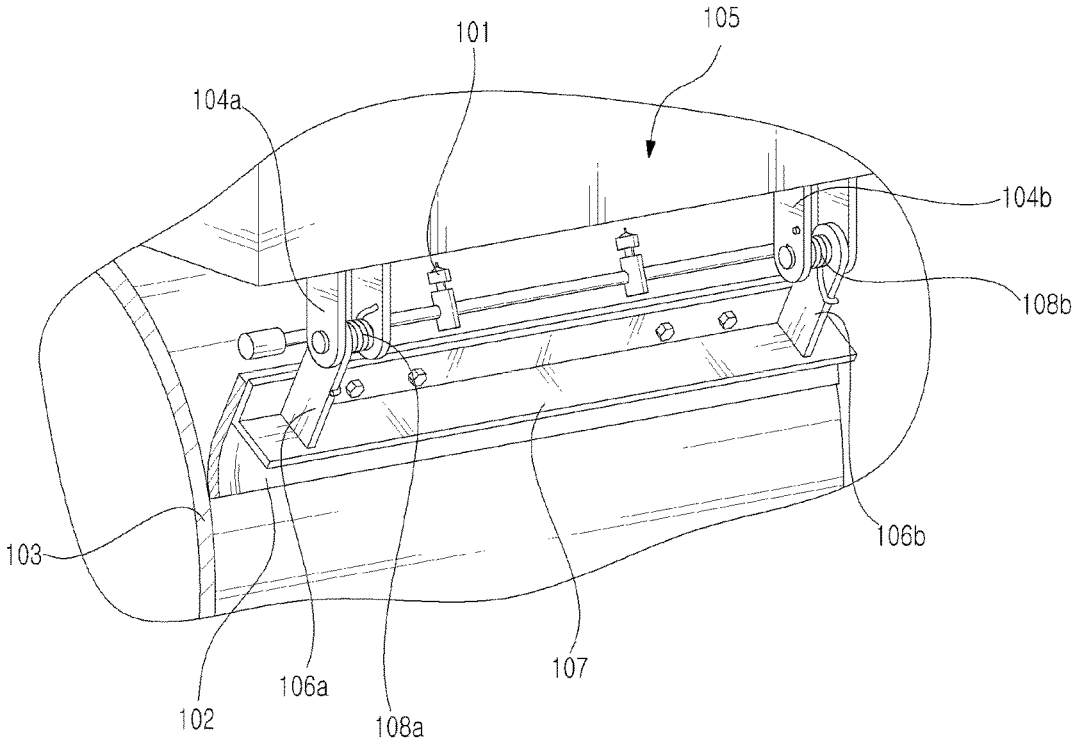
FIG. 1 is a perspective view of a typical prior art drum surface lubricating and cleaning device used on asphalt compactors.
Figure 2:
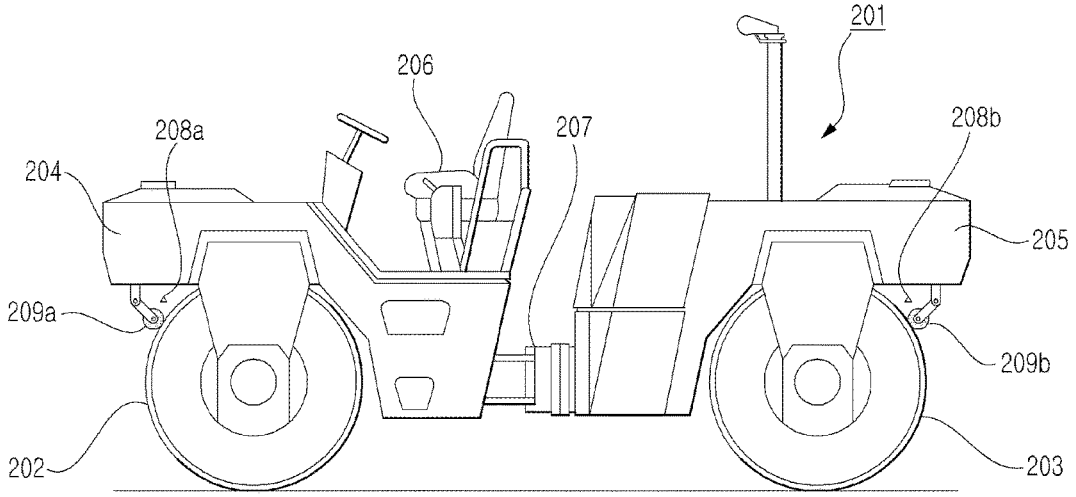
Prior Art FIG. 2
FIG. 2 is a schematic side view of the entire configuration of an asphalt compactor.

FIG. 2 illustrates the schematic configuration of an entire asphalt compactor. As shown in FIG. 2, a compactor 201 is composed of a front drum 202, a rear drum 203, a front body 204 and a rear body 205. A driver's seat 206 is mounted either on front body 204 or on rear body 205. Two bodies 204, 205 are connected with each other by means of a pivot joint 207 so the vehicle can be steered. Water sprays 208*a*, 208*b* and wipers 209*a*, 209*b* are provided for front drum 202 and rear drum 203, respectively.

Figure 3:
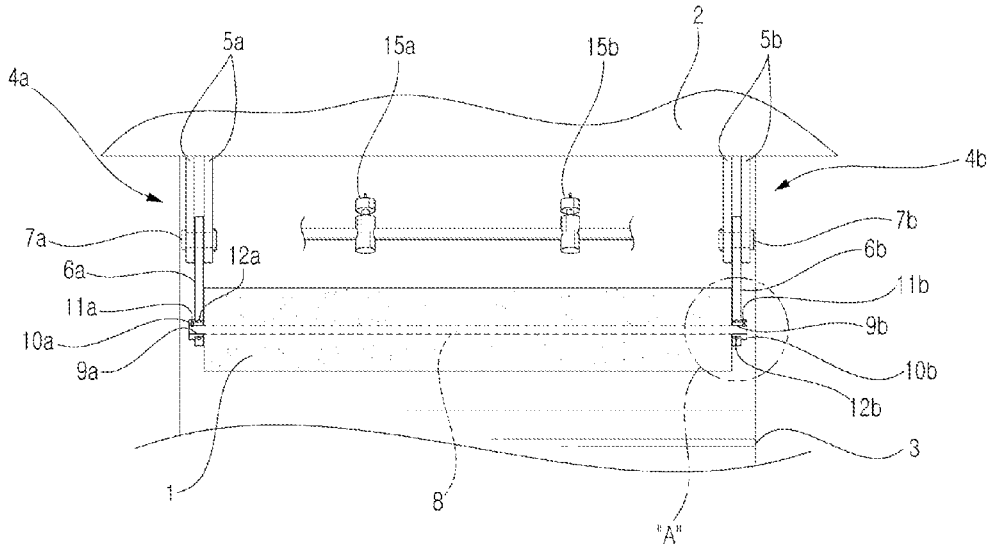
FIG. 3 is a schematic front view of a drum surface cleaning device according to the first embodiment of the invention.
Figure 4:
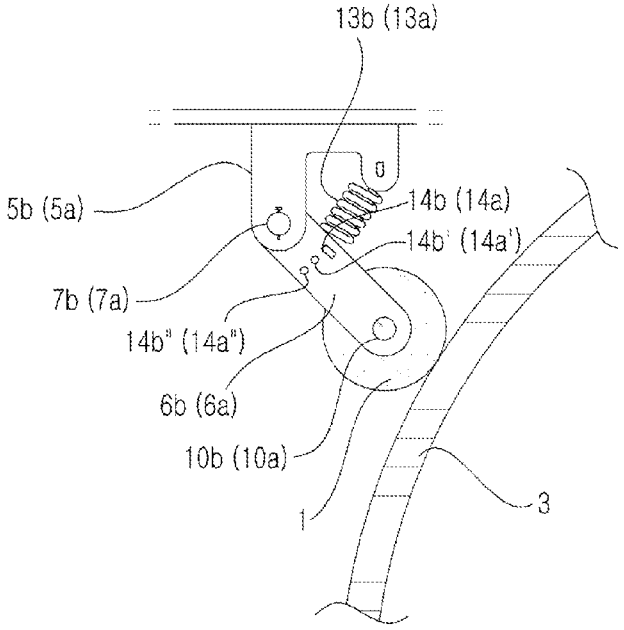
FIG. 4 is a schematic side view of a drum surface cleaning device according to the first embodiment.

FIG. 3 and FIG. 4 illustrate a drum surface cleaning device of asphalt compactors according to one embodiment of the present invention.

Referring to FIG. 3 and FIG. 4, a non-metallic cylindrical roller wiper 1 is provided so that it can resiliently contact the surface of a drum 3. Roller wiper 1 is rotatably mounted to a first and a second identical supporting structure 4*a*, 4*b* fixed to a body 2 of the vehicle (compactor).

The first supporting structure 4*a* has a first pair of brackets 5*a* fixed to body 2 of the vehicle and extending downward. Likewise, the second supporting structure 4*b* has a second pair of brackets 5*b* fixed to body 2 of the vehicle and extending downward. Brackets 5*a*, 5*b* can be welded or bolted to body 2. Brackets 5*a*, 5*b* are spaced apart from each other along the width of drum 3.

A first supporting arm 6*a* is pivotably connected at the lower part of the first pair of brackets 5*a*, and extends downward toward drum 3. There is a first pivot shaft 7*a* disposed between each pair of the first brackets 5*a* about which the first supporting arm 6*a* can pivot up and down. Likewise, A second supporting arm 6*b* is pivotably connected at the lower part of the second pair of brackets 5*b*, and extends downward toward drum 3. There is a second pivot shaft 7*b* disposed between each pair of the second brackets 5*b* about which the second supporting arm 6*b* can pivot up and down.

A roller shaft 8 which is parallel to the rotation axis of drum 3 is rotatably supported by each lower part of the first and the second supporting arms 6*a*, 6*b*. That is, each end of roller shaft 8 passes through holes 9*a*, 9*b* formed at each lower part of the first and the second supporting arms 6*a*, 6*b*.

Figure 5:
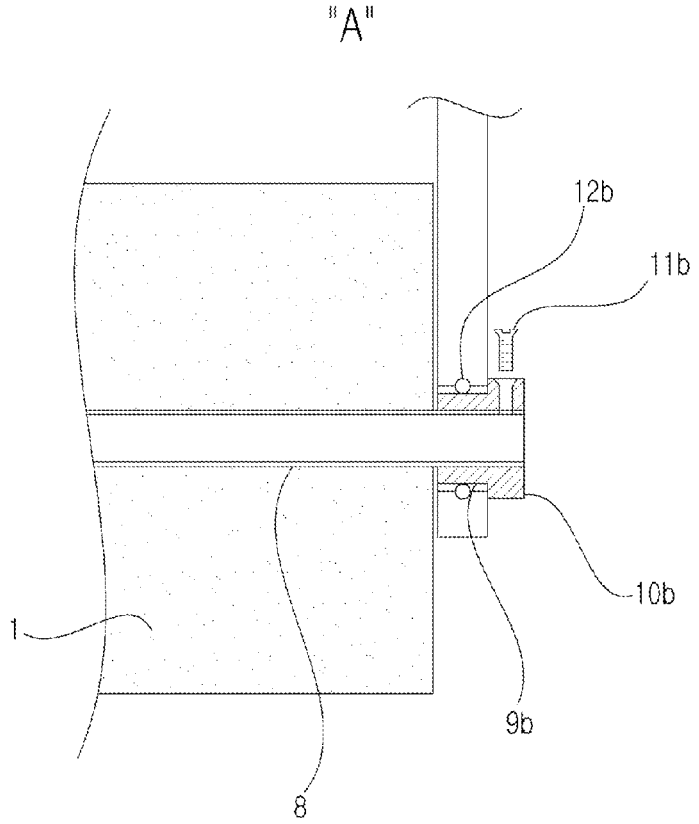
FIG. 5 is an enlarged view of part "A" in FIG. 3.

FIG. 5 is an enlarged view of part "A" in FIG. 3. Referring to FIG. 5, a first and a second adapters 10*a*, 10*b* accommodate the respective ends of roller shaft 8. Namely, adapters 10*a*, 10*b* contact the inner surfaces of holes 9*a*, 9*b* and protrude from supporting arms 6*a*, 6*b* while accommodating roller shaft 8. The protruded parts of adapters 10*a*, 10*b* are larger than the holes 9*a*, 9*b*. The protruded parts of adapters 10*a*, 10*b* have threaded holes through which fixing bolts 11*a*, 11*b* are passing. These fixing bolts 11*a*, 11*b* are then extending through threaded holes formed at the corresponding parts of roller shaft 8. By unscrewing and loosening fixing bolts 11*a*, 11*b*, roller shaft 8 can be disassembled from supporting arms 6*a*, 6*b* for replacement. In this embodiment, fixing bolts 11*a*, 11*b* are used for fixing roller shaft 8 to adapters 10*a*, 10*b*, but it should be noted that other similar means such as fixing pins can be used.

Reference numerals 12*a*, 12*b* are ball bearings installed around inner side of holes 9*a*, 9*b* for enabling smooth rotation of roller shaft 8. Such ball bearings 12*a*, 12*b* can be omitted or replaced by other similar means known to the ordinary skilled in the art.

Roller wiper 1 is mounted to roller shaft 8. Roller wiper 1 extends along the width of drum 3, and contacts the surface of drum 3. Roller wiper 1 is made of non-metallic flexible material, such as, polyurethane, styrene butadiene, elastopal EM, urethane, etc. Hardness can be selected from 80A to 95A, but not limited to this range.

Elastic members 13*a*, 13*b* are engaged between body 2 and each of supporting arms 6*a*, 6*b*. In this embodiment, compression springs are used for these elastic members 13*a*, 13*b*, but it should be noted that other similar means such as gas springs can be used.

One end of the first compression spring 13*a* is fixed to the first pair of brackets 5*a* or directly to body 2, while the other end thereof is fixed to the first supporting arm 6*a*. Preferably, there are a plurality of apertures 14*a*, 14*a*', 14*a*" formed on the first supporting arm 6*a* along the width thereof to receive the other end of the first compression spring 13*a*.

Likewise, one end of the second compression spring 13*b* is fixed to the second pair of brackets 5*b* or directly to body 2, while the other end thereof is fixed to the second supporting arm 6*b*. There are a plurality of apertures 14*b*, 14*b*', 14*b*" formed on the second supporting arm 6*b* along the width thereof to receive the other end of the second compression spring 13*b*.

Compression springs 13*a*, 13*b* exert elastic force to press supporting arms 6*a*, 6*b* against drum 3. Consequently, roller wiper 1 can maintain contact with the surface of drum 3.

It should be noted that the plurality of apertures 14*a*, 14*a*', 14*a*" and 14*b*, 14*b*', 14*b*" can be formed on brackets 5*a*, 5*b*, respectively, in the same manner.

In an initial state of use, compression springs 13*a*, 13*b* are preferably engaged with apertures 14*a*, 14*b*, respectively, which are closer to body 2. However, a continuous friction with the surface of drum 3 causes roller wiper 1 to be worn out. As the diameter of roller wiper 12 is reduced due to this abrasion, compression springs 13*a*, 13*b* can be engaged with other apertures 14*a*', 14*b*' or 14*a*", 14*b*" which are farther from body 2 in order to ensure roller wiper 12 to maintain its contact with the surface of drum 3. Consequently, a proper and constant contact force can be maintained during the lifetime of roller wiper 1.

Reference numerals 15*a*, 15*b* are water spray nozzles installed on a water spray tube 16 extending along the width of drum 3.

Roller wiper 1 can uniformly distribute and spread water from water spray nozzles 15*a*, 15*b* across the entire surface of drum 3 and prevents particles or other material from adhering to the surface of drum 3.

Figure 6:
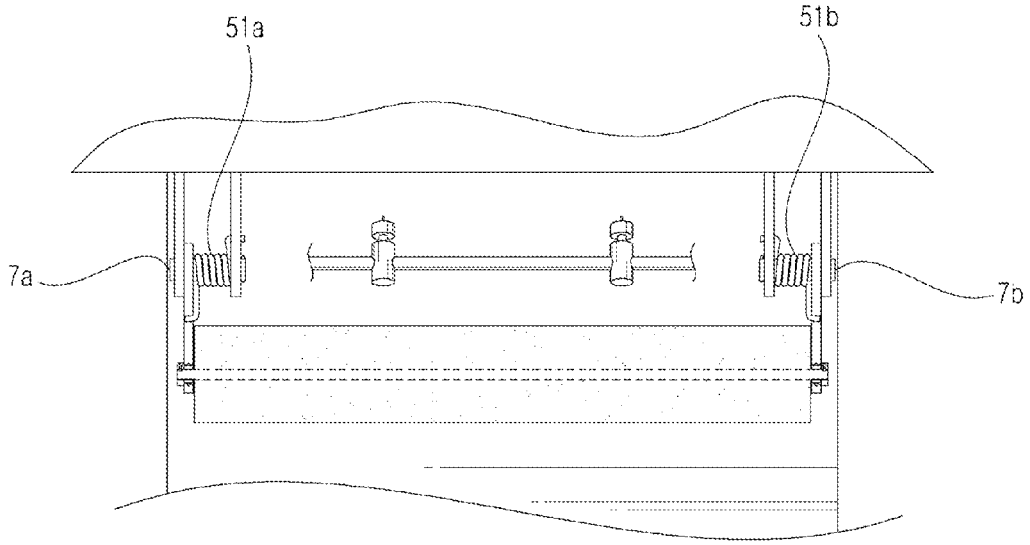
FIG. 6 is a schematic front view of a drum surface cleaning device according to the second embodiment of the invention.
Figure 7:
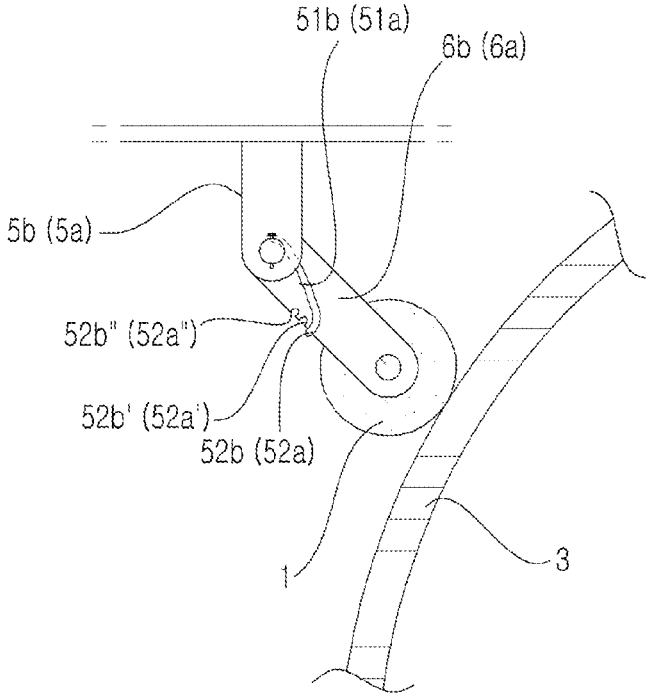
FIG. 7 is a schematic side view of a drum surface cleaning device according to the second embodiment of the invention.

FIG. 6 and FIG. 7 illustrate a drum surface cleaning device of asphalt compactors according to another embodiment of the present invention.

In this embodiment, as the elastic members, torsion springs 51*a*, 51*b* are used, instead of compression springs 13*a*, 13*b* of the first embodiment. Two identical torsion springs 51*a*, 51*b* are mounted on both pivot shafts 7*a*, 7*b*, respectively.

One end of the first torsion spring 51*a* is fixed to either one of the first pair of brackets 5*a*, preferably to the inner-side one, by the manner that the one end thereof extends through an aperture formed on bracket 5*a*. The other end of the first torsion spring 51*a* is positioned in a notch 52*a* of the first supporting arm 6*a*. Preferably, there are a plurality of notches 52*a*, 52*a*', 52*a*" formed on the first supporting arm 6*a* along the length thereof to receive the other end of the first torsion spring 51*a*.

Likewise, one end of the second torsion spring 51*b* is fixed to either one of the second pair of brackets 5*b*, preferably to the inner-side one, by the manner that the one end thereof extends through an aperture formed on bracket 5*b*. The other end of the second torsion spring 51*b* is positioned in a notch 52*b* of the second supporting arm 6*b*. Preferably, there are a plurality of notches 52*b*, 52*b*', 52*b*" formed on the second supporting arm 6*b* along the length thereof to receive the other end of the second torsion spring 51*b*.

Torsion springs 51*a*, 51*b* exert elastic force to press supporting arms 6*a*, 6*b* against drum 3. Consequently, roller wiper 1 can maintain contact with the surface of drum 3.

In an initial state of use, torsion springs 51*a*, 51*b* are preferably engaged with lower notches 52*a*, 52*b*, respectively. However, a continuous friction with the surface of drum 3 causes roller wiper 12 to be worn out. As the diameter of roller wiper 1 is reduced due to this abrasion, torsion springs 51*a*, 51*b* can be engaged with other notches 52*a*', 52' or 52*a*", 52*b*" which are upper in order to ensure roller wiper 1 to maintain its contact with the surface of drum 3. Therefore, a proper contact force can be maintained during the lifetime of roller wiper 1.

In the above embodiments, only one set of cleaning device is installed along the width of the drum where one roller wiper covers a full width of the drum. However, in certain applications, a plurality of such cleaning devices can be installed along the width of the drum.

According to the above described embodiments of the present invention, the roller wiper is worn at a much lower rate from rolling friction, which substantially increases its life comparing with conventional blade wipers worn from sliding friction. Even when the roller wiper is worn, the abrasion takes place uniformly across the entire surface of the roller wiper. Furthermore, by adjusting the tension of the elastic member corresponding to the reduced diameter of the roller wiper due to abrasion, a proper and constant contact force of the roller wiper against the drum surface can be maintained during the entire lifetime of the roller wiper.

Figure 8:
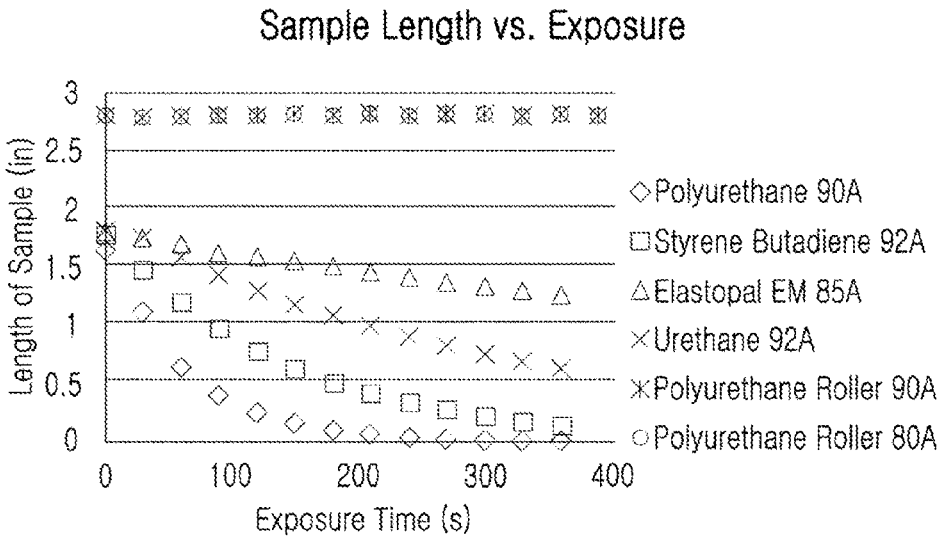
FIG. 8 is a graph showing a test result of abrasivity comparing conventional blade wipers to roller wipers of the invention.

FIG. 8 shows a test result of abrasivity comparing conventional blade wipers to roller wipers of the present invention.

Referring to FIG. 8, the lengths of conventional blade wipers were substantially reduced in process of exposure time, whereas roller wipers of the present invention remained almost unchanged.

It should be noted that the drum surface cleaning devices according to the present invention are not limited to asphalt compactors shown in the embodiments, but can be widely used for various road surface compacting machinery.

Although the invention has been described with reference to the preferred embodiments in the attached figures, it is noted that equivalents may be employed and substitutions made herein without departing from the scope of the invention as recited in the claims.

The invention claimed is:

1. A device for cleaning a drum surface of an asphalt compactor, comprising:

a first and a second brackets fixed to a body of said compactor, said brackets being spaced from each other and extending downward;

a first supporting arm pivotably connected to said first bracket, said first supporting arm extending downward toward said drum;

a second supporting arm pivotably connected to said second bracket, said second supporting arm extending downward toward said drum;

a roller shaft supported by said supporting arms, said roller shaft being parallel to the rotation axis of said drum and extending along the width of said drum;

a roller wiper mounted to said roller shaft, said roller wiper extending along the width of said drum and contacting the surface of said drum;

a first elastic member engaged between said first bracket and said first supporting arm and elastically pressing said roller wiper against the surface of said drum; and a second elastic member engaged between said second bracket and said second supporting arm and elastically pressing said roller wiper against the surface of said drum;

wherein said first elastic member is a first compression spring with a first end fixed to said first bracket and a second end engaged with one of a plurality of apertures formed on said first supporting arm along the width thereof; and said second elastic member is a second compression spring with a first end fixed to said second bracket and a second end engaged with one of a plurality of apertures formed on said second supporting arm along the width thereof.

2. The device according to claim 1, wherein:

in an initial state of use, said second end of said first compression spring is engaged with an aperture which is closer to said body, and said second end of said second compression spring is engaged with an aperture which is closer to said body; and as said roller wiper is worn out, said second end of said first compression spring is engaged with another aperture which is farther from said body, and said second end of said second compression spring is engaged with another aperture which is farther from said body.

3. A device for cleaning a drum surface of an asphalt compactor, comprising:

a first and a second brackets fixed to a body of said compactor, said brackets being spaced from each other and extending downward;

a first supporting arm pivotably connected to said first bracket, said first supporting arm extending downward toward said drum;

a second supporting arm pivotably connected to said second bracket, said second supporting arm extending downward toward said drum;

a roller shaft supported by said supporting arms, said roller shaft being parallel to the rotation axis of said drum and extending along the width of said drum;

a roller wiper mounted to said roller shaft, said roller wiper extending along the width of said drum and contacting the surface of said drum;

a first elastic member engaged between said first bracket and said first supporting arm and elastically pressing said roller wiper against the surface of said drum; and a second elastic member engaged between said second bracket and said second supporting arm and elastically pressing said roller wiper against the surface of said drum;

wherein said first elastic member is a first torsion spring with a first end fixed to said first bracket and a second end positioned in a notch formed on said first supporting arm; and said second elastic member is a second torsion spring with a first end fixed to said second bracket and a second end positioned in a notch formed on said second supporting arm.

4. A device for cleaning a drum surface of an asphalt compactor, comprising:

a first and a second brackets fixed to a body of said compactor, said brackets being spaced from each other and extending downward;

a first supporting arm pivotably connected to said first bracket, said first supporting arm extending downward toward said drum;

a second supporting arm pivotably connected to said second bracket, said second supporting arm extending downward toward said drum;

a roller shaft supported by said supporting arms, said roller shaft being parallel to the rotation axis of said drum and extending along the width of said drum;

a roller wiper mounted to said roller shaft, said roller wiper extending along the width of said drum and contacting the surface of said drum;

a first elastic member engaged between said first bracket and said first supporting arm and elastically pressing said roller wiper against the surface of said drum; and a second elastic member engaged between said second bracket and said second supporting arm and elastically pressing said roller wiper against the surface of said drum;

wherein said first elastic member is a first torsion spring with a first end fixed to said first bracket and a second end positioned in one of a plurality of notches formed on said first supporting arm along the length thereof; and said second elastic member is a second torsion spring with a first end fixed to said second bracket and a second end positioned in one of a plurality of notches formed on said second supporting arm along the length thereof.

5. The device according to claim 4, wherein:

in an initial state of use, said second end of said first torsion spring is positioned in a notch which is lower, and said second end of said second torsion spring is positioned in a notch which is lower; and as said roller wiper is worn out, said second end of said first torsion spring is positioned in another notch which is upper, and said second end of said second torsion spring is positioned in another notch which is upper.

6. A device for cleaning a drum surface of an asphalt compactor, comprising:

a first and a second brackets fixed to a body of said compactor, said brackets being spaced from each other and extending downward;

a first supporting arm pivotably connected to said first bracket, said first supporting arm extending downward toward said drum;

a second supporting arm pivotably connected to said second bracket, said second supporting arm extending downward toward said drum;

a roller shaft supported by said supporting arms, said roller shaft being parallel to the rotation axis of said drum and extending along the width of said drum;

a roller wiper mounted to said roller shaft, said roller wiper extending along the width of said drum and contacting the surface of said drum;

a first elastic member engaged between said first bracket and said first supporting arm and elastically pressing said roller wiper against the surface of said drum; and a second elastic member engaged between said second bracket and said second supporting arm and elastically pressing said roller wiper against the surface of said drum;

wherein said roller shaft has a first end passing through a hole formed at a lower part of said first supporting arm, and a second end passing through a hole formed at a lower part of said second supporting arm;

wherein a first adapter accommodating said first end of said roller shaft, said first adapter contacting the inner surface of said hole formed at said first supporting arm and protruding from said first supporting arm; and a second adapter accommodating said second end of said roller shaft, said second adapter contacting the inner surface of said hole formed at said second supporting arm and protruding from said second supporting arm.

7. The device according to claim 6, further comprising:

a first fixing bolt passing through a threaded hole formed at a protruded part of said first adapter and extending through a threaded hole formed at a corresponding part of said first end of said roller shaft; and a second fixing bolt passing through a threaded hole formed at a protruded part of said second adapter and extending through a threaded hole formed at a corresponding part of said second end of said roller shaft.

8. A device for cleaning a drum surface of an asphalt compactor, comprising:

a first pair of brackets fixed to a body of said compactor and extending downward;

a second pair of brackets fixed to a body of said compactor and extending downward, said first pair of brackets and said second pair of brackets being spaced from each other;

a first pivot shaft disposed between each pair of said first brackets;

a second pivot shaft disposed between each pair of said second brackets;

a first supporting arm pivotably connected to said first brackets and pivoting up and down about said first pivot shaft, said first supporting arm extending downward toward said drum;

a second supporting arm pivotably connected to said second brackets and pivoting up and down about said second pivot shaft, said second supporting arm extending downward toward said drum;

a roller shaft supported by said supporting arms, said roller shaft being parallel to the rotation axis of said drum and extending along the width of said drum;

a roller wiper mounted to said roller shaft, said roller wiper extending along the width of said drum and contacting the surface of said drum;

a first elastic member engaged between said first pair of brackets and said first supporting arm and elastically pressing said roller wiper against the surface of said drum; and a second elastic member engaged between said second pair of brackets and said second supporting arm and elastically pressing said roller wiper against the surface of said drum.

9. The device according to claim 8, wherein:

said first elastic member is a first compression spring with a first end fixed to said first pair of brackets and a second end engaged with an aperture formed on said first supporting arm; and said second elastic member is a second compression spring with a first end fixed to said second pair of brackets and a second end engaged with an aperture formed on said second supporting arm.

10. The device according to claim 8, wherein:

said first elastic member is a first compression spring with a first end fixed to said first pair of brackets and a second end engaged with one of a plurality of apertures formed on said first supporting arm along the width thereof; and said second elastic member is a second compression spring with a first end fixed to said second pair of brackets and a second end engaged with one of a plurality of apertures formed on said second supporting arm along the width thereof.

11. The device according to claim 10, wherein:

in an initial state of use, said second end of said first compression spring is engaged with an aperture which is closer to said body, and said second end of said second compression spring is engaged with an aperture which is closer to said body; and as said roller wiper is worn out, said second end of said first compression spring is engaged with another aperture which is farther from said body, and said second end of said second compression spring is engaged with another aperture which is farther from said body.

12. The device according to claim 8, wherein:

said first elastic member is a first torsion spring mounted on said first pivot shaft, said first torsion spring having a first end fixed to said first pair of brackets and a second end positioned in a notch formed on said first supporting arm; and said second elastic member is a second torsion spring mounted on said second pivot shaft, said second torsion spring having a first end fixed to said second pair of brackets and a second end positioned in a notch formed on said second supporting arm.

13. The device according to claim 8, wherein:

said first elastic member is a first torsion spring mounted on said first pivot shaft, said first torsion spring having a first end fixed to said first pair of brackets and a second end positioned in one of a plurality of notches formed on said first supporting arm along the length thereof; and said second elastic member is a second torsion spring mounted on said second pivot shaft, said second torsion spring having a first end fixed to said second pair of brackets and a second end positioned in one of a plurality of notches formed on said second supporting arm along the length thereof.

14. The device according to claim 13, wherein:

in an initial state of use, said second end of said first torsion spring is positioned in a notch which is lower, and said second end of said second torsion spring is positioned in a notch which is lower; and as said roller wiper is worn out, said second end of said first torsion spring is positioned in another notch which is upper, and said second end of said second torsion spring is positioned in another notch which is upper.

15. The device according to claim 8, wherein:

said roller shaft has a first end passing through a hole formed at a lower part of said first supporting arm, and a second end passing through a hole formed at a lower part of said second supporting arm.

16. The device according to claim 15, further comprising:

a first adapter accommodating said first end of said roller shaft, said first adapter contacting the inner surface of said hole formed at said first supporting arm and protruding from said first supporting arm; and a second adapter accommodating said second end of said roller shaft, said second adapter contacting the inner surface of said hole formed at said second supporting arm and protruding from said second supporting arm.

17. The device according to claim 16, further comprising:

a first fixing bolt passing through a threaded hole formed at a protruded part of said first adapter and extending through a threaded hole formed at a corresponding part of said first end of said roller shaft; and a second fixing bolt passing through a threaded hole formed at a protruded part of said second adapter and extending through a threaded hole formed at a corresponding part of said second end of said roller shaft.

18. A device for cleaning a drum surface of an asphalt compactor, comprising:

a first and a second brackets fixed to a body of said compactor, said brackets being spaced from each other and extending downward;

a first supporting arm pivotably connected to said first bracket, said first supporting arm extending downward toward said drum;

a second supporting arm pivotably connected to said second bracket, said second supporting arm extending downward toward said drum;

a roller shaft supported by said supporting arms, said roller shaft being parallel to the rotation axis of said drum;

a roller wiper mounted to said roller shaft, said roller wiper contacting the surface of said drum;

a first elastic member engaged between said first bracket and said first supporting arm and elastically pressing said roller wiper against the surface of said drum; and a second elastic member engaged between said second bracket and said second supporting arm and elastically pressing said roller wiper against the surface of said drum.

* * * * *